US006694787B1

(12) United States Patent
Brown

(10) Patent No.: US 6,694,787 B1
(45) Date of Patent: Feb. 24, 2004

(54) METHOD OF PREVENTING PERSONS FROM FORGETTING A DOOR KEY AND BEING LOCKED OUT OF A ROOM

(76) Inventor: Kent L. Brown, 3523 University Ave., Apt. 12A, Des Moines, IA (US) 50311

( * ) Notice: Subject to any disclaimer, the term of this patent is extended or adjusted under 35 U.S.C. 154(b) by 0 days.

(21) Appl. No.: 10/300,143

(22) Filed: Nov. 20, 2002

(51) Int. Cl.[7] ..... A47G 29/10
(52) U.S. Cl. ..... 70/456 R; 70/429
(58) Field of Search ..... 70/429, 430, 456 R; 292/DIG. 17; 24/3.6; 206/37.1, 38.1; 211/87.01, 119.004; 224/572; 116/8–10, 167, 172

(56) References Cited

U.S. PATENT DOCUMENTS

| | | | | | |
|---|---|---|---|---|---|
| 188,795 | A | * | 3/1877 | Griswold | 116/8 |
| 380,043 | A | * | 3/1888 | Manyett | 116/10 |
| 391,724 | A | * | 10/1888 | Teichman | 116/86 |
| 402,413 | A | * | 4/1889 | Day | 116/8 |
| 613,029 | A | * | 10/1898 | Fair | 24/3.6 X |
| 650,229 | A | | 5/1900 | Comeau | |
| 763,920 | A | | 6/1904 | Morell | |
| 780,985 | A | * | 1/1905 | Fossum | 70/456 R |
| 820,696 | A | | 5/1906 | Brickell | |
| 1,074,359 | A | | 9/1913 | Heimbaugh | |
| 1,095,247 | A | * | 5/1914 | Toce | 24/3.6 |
| 1,420,335 | A | * | 6/1922 | Oberlander | 40/634 |
| 1,887,951 | A | * | 11/1932 | Crum | 70/429 |
| 2,064,691 | A | * | 12/1936 | Schmitz | 70/429 |
| 2,071,757 | A | * | 2/1937 | Matthews | 206/38.1 |
| 2,078,293 | A | * | 4/1937 | Smith, Jr. et al. | 40/2 |
| 2,413,337 | A | * | 12/1946 | Segal | 24/163 R |
| 2,638,773 | A | | 5/1953 | Griesbach | |
| 3,063,117 | A | * | 11/1962 | Rubin et al. | 24/178 R |
| 3,124,286 | A | * | 3/1964 | Dompier | 224/255 |
| 3,564,744 | A | * | 2/1971 | Shook | 70/455 X |
| 3,613,414 | A | | 10/1971 | Ostrager | |
| 3,707,742 | A | * | 1/1973 | Justice et al. | 24/3.6 |
| 3,922,895 | A | * | 12/1975 | Greenebaum | 70/457 X |
| 3,968,669 | A | | 7/1976 | Coleman | |
| 3,974,543 | A | * | 8/1976 | Thomas | 24/67.11 |
| 3,978,902 | A | * | 9/1976 | Adkinson | 70/456 R |
| 4,100,779 | A | * | 7/1978 | Schachter | 70/456 R |

(List continued on next page.)

FOREIGN PATENT DOCUMENTS

| | | | |
|---|---|---|---|
| FR | 2803723 | * | 7/2003 |
| NL | 1018824 | * | 8/2001 |
| WO | WO93/03643 | * | 3/1992 |

OTHER PUBLICATIONS

Declaration of Kent L. Brown.

*Primary Examiner*—Suzanne Dino Barrett

(57) ABSTRACT

A method of reminding a person from locking themselves out of a room or dwelling comprises the steps of hanging a key on a door frame adjacent a door opening having a door hingedly mounted thereon, in such a position that when the door is swung open with respect to the door frame, the door will engage the key and dislodge the key from its means of support to cause it to fall to a floor surface adjacent the door opening. These steps alert the person of the presence of the key so as to remind the person to pick up and retain the key before allowing the door to close, thus preventing the person from being locked out of entry to the room without the key if the door automatically locks upon closing.

7 Claims, 3 Drawing Sheets

U.S. PATENT DOCUMENTS 4,226,105 A * 10/1980 Wehrman ..... 70/456 R
4,239,270 A * 12/1980 Bridges ..... 292/1 X
4,339,045 A * 7/1982 Bodin ..... 211/13
4,359,888 A * 11/1982 Scheineman ..... 70/457
4,516,515 A * 5/1985 Johnson ..... 114/197
4,521,939 A * 6/1985 Chabot et al. ..... 24/188
4,653,422 A * 3/1987 Allen ..... 70/456 X
4,936,244 A * 6/1990 Hansen et al. ..... 116/28 R
5,058,523 A * 10/1991 Mikkonen et al. ..... 116/28 R
5,265,451 A * 11/1993 Phifer ..... 70/226
5,269,392 A * 12/1993 Perrotti ..... 70/429 X
5,461,360 A * 10/1995 Guim et al. ..... 340/457
5,551,269 A * 9/1996 Lewinstein et al. ..... 70/459
5,659,291 A * 8/1997 Kennedy et al. ..... 70/236 X
5,884,514 A * 3/1999 Willis ..... 70/456 R
6,082,160 A * 7/2000 Martyniak ..... 70/431
6,104,288 A * 8/2000 Hopkins ..... 340/545.1
6,109,492 A * 8/2000 Eastwood ..... 70/456 R
6,178,787 B1 * 1/2001 Titterton ..... 70/424 X
6,193,084 B1 2/2001 Oliver
6,219,949 B1 * 4/2001 Pang ..... 40/599
6,230,530 B1 * 5/2001 Voigt et al. ..... 70/441
6,392,560 B1 * 5/2002 Stuehling et al. ..... 340/825.72
6,505,987 B1 * 1/2003 Turner, III et al. ..... 70/456 R

* cited by examiner

METHOD OF PREVENTING PERSONS FROM FORGETTING A DOOR KEY AND BEING LOCKED OUT OF A ROOM

BACKGROUND OF THE INVENTION

It has been determined that mentally deficient persons will often leave their premises wherein the door will automatically lock behind them and the person will have forgotten to take an entry key with them. This means that the custodian of the premises will have to unlock the door for such persons, and it has also been determined that such persons often will react very negatively in self-abusive ways because they have forgotten their key and have locked themselves out of the premises.

It is therefore a principal object of this invention to provide a method of reminding persons, and particularly mentally deficient person from locking themselves out of a room or dwelling. A further object of this invention is to provide an inexpensive and easily implemented method of reminding a mentally deficient person from locking themselves out of a room or dwelling.

These and other objects will be apparent to those skilled in the art.

SUMMARY OF THE INVENTION

A method of reminding persons, and particularly mentally deficient person from locking themselves out of a room or dwelling comprises the steps of hanging a key on a door frame adjacent a door opening having a door hingedly mounted thereon, in such a position that when the door is swung open with respect to the door frame, the door or lever attached to the door will engage the key and dislodge the key from its means of support to cause it to fall to a floor surface adjacent the door opening. These steps alert the person of the presence of the key so as to remind the person to pick up and retain the key before allowing the door to close, thus preventing the person from being locked out of entry to the room without the key if the door automatically locks upon closing.

DESCRIPTION OF THE PREFERRED EMBODIMENTS

Figure 1:
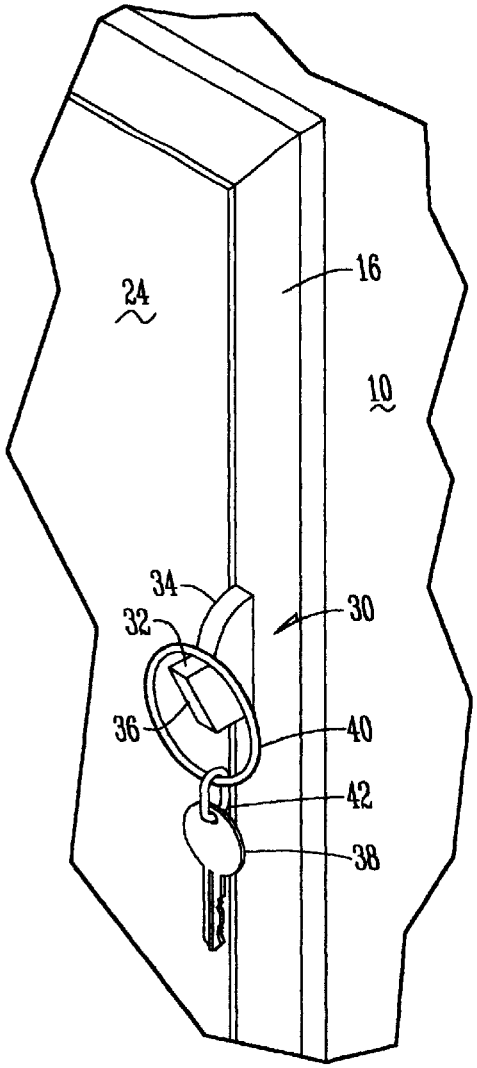
FIG. 1 is a perspective view of the key mounted in a "reminder" position.
Figure 2:
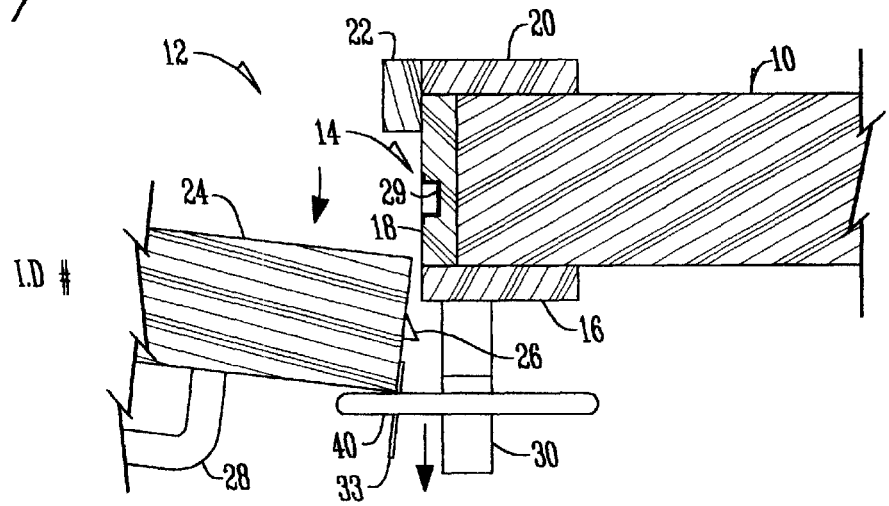
FIG. 2 is a horizontal sectional view showing how the door, upon being opened, engages the key for dislodgement from its position of retainment.

An exterior wall 10 of interior room 11 (FIG. 2) has a conventional door opening 12 with a door frame 14 comprised of door frame member 16, 18 and 20 (FIGS. 1 and 2). The door frame member 16 has a conventional door stop 22.

Door 24 has a conventional latch 26 and a door latch handle 28 to actuate the same. The latch 26 is spring loaded and conventionally has the ability to be inserted into and withdrawn from latch keeper 29 (FIG. 2).

Figure 3:
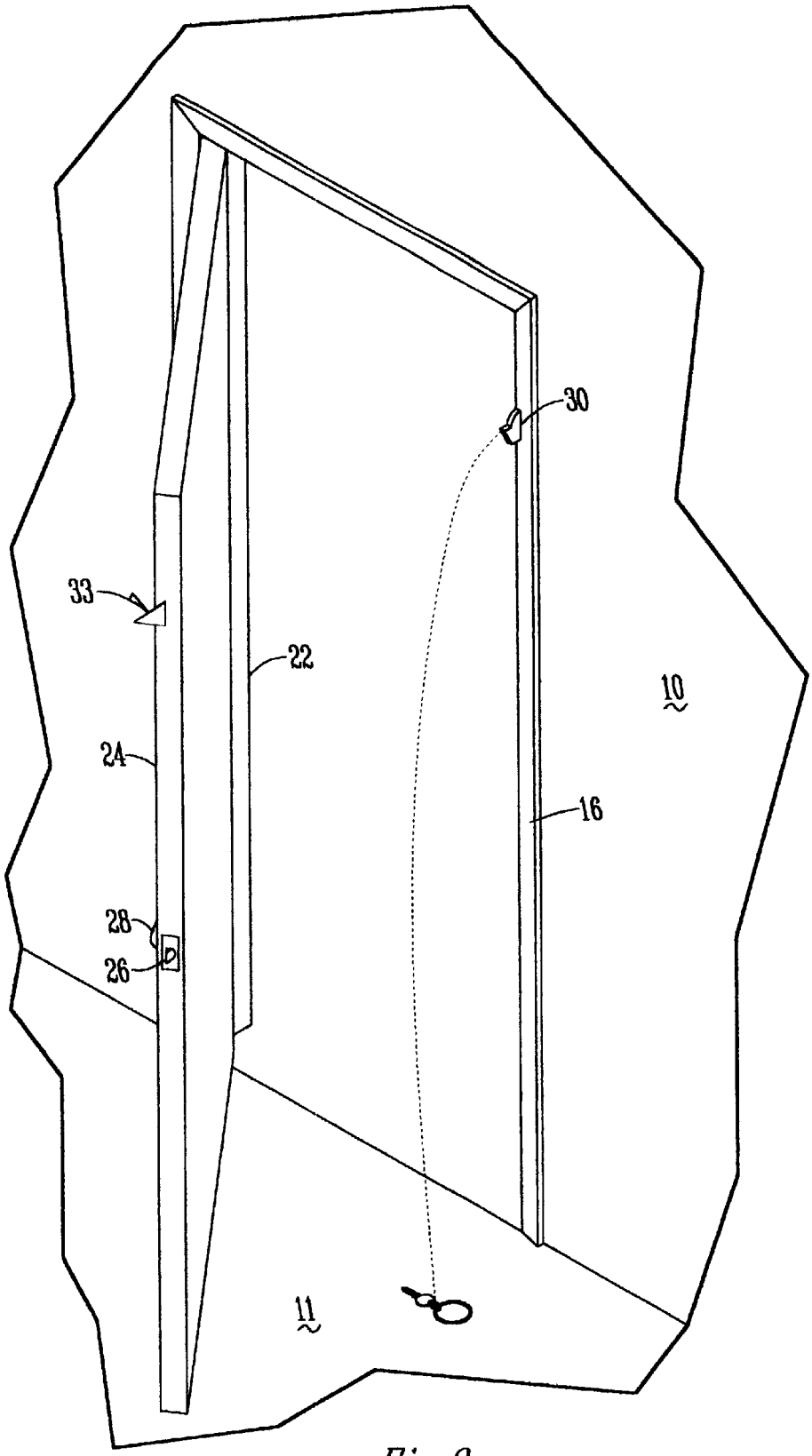
FIG. 3 is a perspective view of the open door of this invention.
Figure 4:
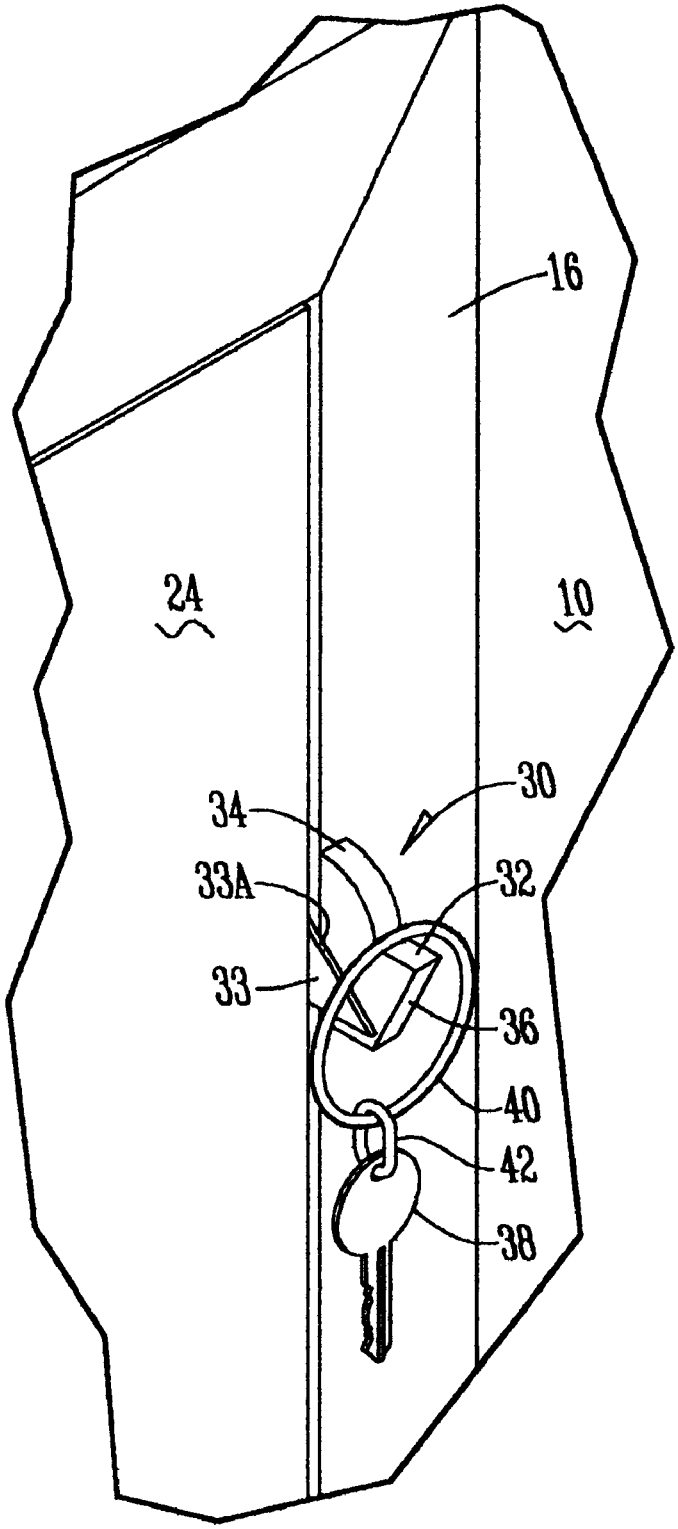
FIG. 4 is a perspective view similar to FIG. 1 but showing the opposite side of the structure of FIG. 1.

The key ring 38 has a larger primary key ring 40 and a secondary key ring 42. In practice, the primary key ring 40 is placed on the key support surface 32 so that one segment of the ring will be in the path of door 24 and lever 33 as it is opened. See FIG. 2. As the door is opened further, the lever 33 will penetrate the key ring 40 and cause it to be pushed outwardly off of the end of support surface 32 upon engaging tapered edge 33A, whereupon the key rings 40, 42 and the key 38 will fall to the floor surface as illustrated in FIG. 3. Thus, if the person involved will remember to hang the key 38 on the key retaining bracket 30 as shown in FIG. 2, and if the door is self-locking, and if the person forgets to remove key 38 from the retaining bracket 30 when departing the room 11, the opening of the door will remove the key in the manner described and the person will be reminded of the presence of the key as it falls to the floor.

The key 38 has a primary key ring 40 and a larger secondary key ring 42. In practice, the secondary key ring 42 is placed on the key support surface 32 so that one segment of the ring will be in the path of door 24 and lever 33 as it is opened. See FIG. 2. As the door is opened further, the lever 33 will penetrate the key ring 42 and cause it to be pushed outwardly off of the end of support surface 32 upon engaging tapered edge 33A, whereupon the key rings and the key will fall to the floor surface as illustrated in FIG. 3. Thus, if the person involved will remember to hang the key 38 on the key retaining bracket 30 as shown in FIG. 2, and if the door is self-locking, and if the person forgets to remove key 38 from the retaining bracket 30 when departing the room 11, the opening of the door will remove the key in the manner described and the person will be reminded of the presence of the key as it falls to the floor.

While lever element 33 with tapered edge 33A is preferred, the method would still be operative if the lever element 33 was removed and the ring 42 was engaged only by the door 24.

It is therefore seen that this method can be easily and inexpensively implemented, yet will be very effective by causing the key to come to the attention of the person involved in the event that the person forgets to have the key on their person as they depart the premises.

What is claimed is:

1. In combination, a wall with a door opening, a door frame in the opening, a door hingedly mounted on the door frame on a vertical edge therefrom to pivot about a vertical axis between closed and open positions with respect to the door frame, a key support member mounted on the door frame adjacent an outer vertical edge of the door so that a key on the support member will be engaged by the outer vertical edge of the door and removed from the support member when the door is moved to an open position.

2. The combination of claim 1 wherein a tapered lever is secured to the outer vertical edge of the door to engage the ring of a ring-mounted key on the support member when the door is opened.

3. A device used to remind a person not to lock themselves out of a dwelling comprising:

a door frame;

a door hingedly connected to the door frame;

a retaining bracket adapted to retain a key ring securedly connected to the door frame so that the door engages the key ring when moved from a closed position to an open position to therby remove the key ring from the retaining bracket.

4. The device of claim 3 further comprising a lever securably connected to the door and adjacent to the retaining bracket so that when the door is moved to the open position the lever is disposed through the key ring.

5. The device of claim 4 wherein the lever is tapered at a downward angle so as to facilitate the key ring in sliding off of the lever.

6. A method of reminding a person to remember their keys when leaving a dwelling, the method steps comprising:

attaching a retaining bracket adapted to retain a key ring to a door frame;

placing a key ring on the retaining bracket by disposing the retaining bracket through the center of the key ring; and opening a door so that the door engages the key ring causing the key ring to fall to the floor.

7. The method of claim 6 further comprising the steps of:

securing a lever to the door adjacent having a downwardly tapered edge adjacent to the retaining bracket;

disposing the lever through the key ring by opening the door;

sliding the key ring down the tapered edge and off of the lever.

* * * * *